US008861172B2

(12) United States Patent
Hummel et al.

(10) Patent No.: US 8,861,172 B2
(45) Date of Patent: Oct. 14, 2014

(54) CALIBRATION OF DETONATORS

(75) Inventors: Dirk Hummel, Hennef (DE); Michael John McCann, Chadds Ford, PA (US)

(73) Assignee: Orica Explosives Technology Pty Ltd., Melbourne, Victoria (AU)

( * ) Notice: Subject to any disclaimer, the term of this patent is extended or adjusted under 35 U.S.C. 154(b) by 967 days.

(21) Appl. No.: 12/993,939

(22) PCT Filed: May 29, 2009

(86) PCT No.: PCT/AU2009/000679
§ 371 (c)(1),
(2), (4) Date: Mar. 7, 2011

(87) PCT Pub. No.: WO2009/143585
PCT Pub. Date: Dec. 3, 2009

(65) Prior Publication Data

US 2011/0265677 A1 Nov. 3, 2011

Related U.S. Application Data

(60) Provisional application No. 61/130,354, filed on May 29, 2008.

(51) Int. Cl.
*F23Q 3/00* (2006.01)
*F42D 1/055* (2006.01)
*F42D 1/045* (2006.01)

(52) U.S. Cl.
CPC ..... *F42D 1/055* (2013.01); *F42D 1/045* (2013.01)
USPC ..... 361/247

(58) Field of Classification Search
USPC ..... 361/247, 248; 102/215
See application file for complete search history.

(56) References Cited

U.S. PATENT DOCUMENTS 3,913,021 A 10/1975 McCarthy et al.
4,869,171 A 9/1989 Abouav
5,239,677 A * 8/1993 Jasinski ..... 455/509
5,367,957 A 11/1994 Hennessey (Continued)

FOREIGN PATENT DOCUMENTS

WO WO-9616310 A1 5/1996
WO WO-2006076777 A1 7/2006

(Continued)

OTHER PUBLICATIONS

International Search Report for PCT/AU2009/000679 (date of mailing Mar. 12, 2009).

(Continued)

*Primary Examiner* — Jared Fureman
*Assistant Examiner* — Joseph Inge
(74) *Attorney, Agent, or Firm* — Charles E. Lyon; John J. Cahill, Jr.

(57) ABSTRACT

A plurality of detonator assemblies in signal communication with a blasting machine, each detonator assembly consisting of a detonator, a storage compartment for storing programmed delay time and/or oscillation count and a countdown oscillator. A transmitter for transmitting a blast rehearsal stop start and stop signal, said signals being separated by said programmed delay time individually selected for each detonator signal. The oscillator counting the total oscillation count corresponding to said delay time. When a detonator assembly receives a FIRE command, the individual countdown oscillators countdowns the total oscillation count associated with its detonator assembly.

18 Claims, 4 Drawing Sheets

(56) References Cited

U.S. PATENT DOCUMENTS

| | | | | |
|---|---|---|---|---|
| 5,602,713 | A * | 2/1997 | Kurogi et al. | 361/249 |
| 7,146,912 | B2 | 12/2006 | Bokvist et al. | |
| 2005/0030695 | A1 * | 2/2005 | Meyer et al. | 361/248 |
| 2012/0174809 | A1 * | 7/2012 | Stewart et al. | 102/215 |

FOREIGN PATENT DOCUMENTS

| | | | |
|---|---|---|---|
| WO | WO-2007051231 | A1 | 5/2007 |
| WO | WO-2008098302 | A1 | 8/2008 |
| WO | WO-2008138070 | A1 | 11/2008 |

OTHER PUBLICATIONS

Supplementary European Search Report for EP 09753349.1, 8 pages. (Nov. 15, 2013).

* cited by examiner

CALIBRATION OF DETONATORS

CROSS-REFERENCE TO RELATED APPLICATION

This application claims the priority right of U.S. Patent Application 61/130,354 filed May 29, 2008 by Applicants herein.

FIELD OF THE INVENTION

The present invention relates to the field of mining, and actuation of detonators and associated explosive charges at a blast site. More particularly, the invention relates to calibration of electronic delay detonators (EDDs) for improved accuracy of timed actuation.

BACKGROUND TO THE INVENTION

The operation of electronically timed detonators, also known as electronic delay detonators, or EDDs, for blasting, mining, quarrying and similar operations is conventionally performed by use of a network or harness of wires that connect all the detonators together, and the devices that control them. Typically, each detonator is located below ground associated with a mass bulk of explosive material, with a connection made to the aforesaid harness at the top of the hole which contains the explosive.

This surface harness wire network must be connected to the detonators at the blast site to other components such as blasting machines. This process causes significant labour costs and generates many of the faults that occur due to failed or damaged connections. Moreover, the wire itself becomes a nuisance. Firstly it prevents easy movement of men and vehicles over the blasting site and is itself easily damaged. Secondly it has to be gathered for disposal being unfit for reuse or it becomes an undesirable material contaminant of the ore body being extracted.

It is therefore desirable to eliminate the surface wiring for EDDs and control the detonators remotely using some wireless means of communication. EDDs to be effective and safe preferably have two-way communication with the controlling device in direct communication with the detonators, also known as the blasting machine. Often, the communication means must therefore provide reliable transfer of messages, from a blasting machine to a large number of EDDs. The physical circumstances, particularly in open cast mining or quarrying, give rise to EDDs being laid out in patterns that can extend several hundreds of meters over somewhat irregular terrain.

Persons of skill in the art recognize the potential of wireless detonator systems for significant improvements in safety at the blast site. By avoiding the use of "wired" physical connections (e.g. electrical wires, shock tubes, LEDC, or optical cables) between detonators, and other components at the blast site (e.g. blasting machines) the possibility of improper set-up of the blasting arrangement is reduced. With traditional, "wired" blasting arrangements, significant skill and care is required by a blasting operator to establish proper connections between the wires and the components of the blasting arrangement. In addition, significant care is required to ensure that the wires lead from the explosive charge (and an associated detonator) to a blasting machine without disruption, snagging, damage or other interference that could prevent proper control and operation of the detonator via the attached blasting machine. Wireless blasting systems offer the hope of circumventing these problems.

Another advantage of wireless blasting systems relates to facilitation of automated establishment of the explosive charges and associated detonators at the blast site. This may include for example automated detonator loading in boreholes, and automated association of a corresponding detonator with each explosive charge. Automated establishment of an array of explosive charges and detonators at a blast site, for example by employing robotic systems, would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of detonators at the blast site, particularly where the detonators require tieing-in or other forms of hook up to electrical wires, shock tubes or the like. Wireless detonators and corresponding wireless detonator systems will help to circumvent such difficulties, and are clearly more amenable to application with automated mining operations. In addition, manual set up and tieing in of detonators via physical connections is very labour intensive, requiring significant time of blast operator time. In contrast, automated blasting systems are significantly less labour intensive, since much of the set-up procedure involves robotic systems rather than blast operator's time.

Progress has been made in the development wireless detonator assemblies, and wireless blasting systems that are suitable for use in mining operations, including detonators and systems that are amenable to automated set-up at the blast site. Nonetheless, existing wireless blasting systems still present significant operational concerns, and improvements are required if wireless systems are to become a viable alternative to traditional "wired" blasting systems. These concerns include, but are not limited to, calibration of detonators for a timed blasting event. An array of detonators at a blast site may include several, perhaps hundreds, of EDDs, and each may be individually programmed with a carefully selected delay time. At a time of blasting, a blasting machine (or machines) associated with the detonators may transmit to the detonators a command signal to FIRE upon which time the detonators count down their respective, pre-programmed delay times. For selected EDDs, such delay times may be programmed with an accuracy of lms or sometimes even greater.

Typically, each EDD at a blast site may have its own internal (or otherwise individually associated) clock to countdown its programmed delay time. To account for variance in clock accuracy either between individual detonator clocks, or for each detonator clock over a period of time, detonator clocks are generally calibrated at the blast site just prior to detonator initiation, for example by checking the rate of oscillation of each detonator clock against a standard (i.e. "master") clock. For example, each EDD may have transmitted thereto a calibration-count-start signal and a calibration-count-stop signal, wherein the start and stop signals are separated by a fixed, known time interval. For example, if the start and stop signals transmitted by a master clock are 1024 ms apart, each detonator can record its own clock count for the intervening 1024 ms period between the receipt of the two signals, and this clock count is then used (either by the detonator or more commonly by an associated blasting machine) to establish its accuracy relative to the master clock. Subsequently, each clock count of each detonator may be adjusted to count down its programmed delay time with compensation for any inaccuracy in its internal clock.

Such calibration techniques are more particularly useful for shorter delay times. However, detonator clock speeds may vary somewhat over time, and clocks may drift relative to one another if such variances remain unchecked. For example, each detonator will have its own internal capacitor, with current draw and voltage characteristics that will affect clock operation over time. Thus, when longer delay times are employed clock accuracy may deteriorate even after calibration of detonator clocks in accordance with the methods discussed above. This applies not only to blasting systems that employ a surface harness wired network, but also applies more particularly to wireless detonator systems involving wireless detonator assemblies, which must be individually powered by an internal power supply, the latter, inevitably, giving another source of variation in the system. It follows that improvements are required in methods and apparatuses for detonator clock calibration.

SUMMARY OF THE INVENTION

It is another object, at least in preferred embodiments, to provide an apparatus for blasting, with calibration of detonators for timed actuation.

It is one object, at least in preferred embodiments, to provide a method of calibrating detonators at a blast site, wherein said detonators can undergo timed actuation.

Embodiments and advantages of the present invention will become apparent from a reading and understanding of the entire specification.

Certain exemplary embodiments provide an apparatus for conducting a blasting event, the apparatus comprising:

at least one blasting machine for sending command signals to a plurality of associated detonator assemblies;

a plurality of detonator assemblies in signal communication with said at least one blasting machine, each detonator assembly comprising:

(i) a detonator including a base charge connected to a firing circuit;

(ii) a storage component for storing a programmed delay time and/or a total oscillation count;

(iii) a countdown oscillator;

at least one high-accuracy clock each either in communication with, or forming an integral component of, at least one detonator assembly, and comprising a transmitter for transmitting a blast-rehearsal start signal and a blast-rehearsal stop signal to each countdown oscillator of each associated detonator assembly, said signals being temporally separated by a time period corresponding to a desired delay time individually selected for each detonator assembly, each oscillator counting a number of oscillations between said signals to determine a total oscillation count for each oscillator corresponding to said desired delay time specific for each detonator assembly;

whereupon receipt by said at least one detonator assembly of a command signal to FIRE from said at least one blasting machine, each countdown oscillator counting down its total oscillation count, thereby to achieve timed actuation of each detonator in accordance with its desired delay time.

Other exemplary embodiments provide a method for calibrating a detonator assembly for a blasting event, said detonator assembly comprising:

(i) a detonator including a base charge connected to a firing circuit;

(ii) a storage component for storing a programmed delay time and/or a total oscillation count;

(iii) a countdown oscillator;

wherein the method comprises the steps of:

(1) determining a total oscillation count for said countdown oscillator corresponding to a desired delay time specific for said detonator assembly, said step of determining comprising:

(1a) starting a high-accuracy clock either in communication with or forming an integral component of the detonator assembly, and simultaneously transmitting a blast-rehearsal start signal to said countdown oscillator to cause said oscillator to start counting its oscillations;

(1b) after a time-period has elapsed corresponding to said desired delay time said high-accuracy clock transmitting a blast-rehearsal stop signal to cause said oscillator to stop counting its oscillations, thus to provide said total oscillation count; and (2) storing said total oscillation count ready for said oscillator to count down said total oscillation count upon receipt by the detonator assembly of a signal to FIRE, whereupon completion of countdown of said total oscillation count, said base charge is actuated via said firing circuit.

Other exemplary embodiments provide a method for calibrating a plurality of detonator assemblies for a blasting event, each detonator assembly comprising:

(i) a detonator including a base charge connected to a firing circuit;

(ii) a storage component for storing a programmed delay time and/or a total oscillation count;

(iii) a countdown oscillator;

wherein the method comprises the steps of:

(1) determining a total oscillation count for each countdown oscillator corresponding to a desired delay time specific for each detonator assembly, said step of determining comprising:

(1a) starting a high-accuracy clock either in communication with or forming an integral component of each detonator assembly, and simultaneously transmitting a blast-rehearsal start signal to each countdown oscillator to cause each oscillator to start counting its oscillations;

(1b) after a time-period has elapsed corresponding to each desired delay time each high-accuracy clock transmitting a blast-rehearsal stop signal to cause each oscillator to stop counting its oscillations, thus to provide said total oscillation count corresponding to each desired delay time for each detonator assembly; and (2) storing said total oscillation counts ready for said oscillators to count down said total oscillation counts upon receipt by the detonator assemblies of a signal to FIRE, whereupon completion of countdown of each total oscillation count, each base charge is actuated via said firing circuit, thereby to achieve timed actuation of the detonators in accordance with their desired delay times.

Other exemplary embodiments provide a method for programming a plurality of detonators or detonator assemblies with delay times, and calibrating the internal oscillators of the detonators or detonator assemblies, the method comprising the step of:

transmitting to each detonator or detonator assembly a pair of signals comprising a blast rehearsal start signal and a blast rehearsal stop signal, said pair of signals being temporally spaced by a time-period equivalent to a desired delay time for each detonator or detonator assembly, wherein each detonator or detonator assembly counts and stores a number of oscillations for its internal oscillator for said time-period;

whereupon receipt of a command signal to FIRE, each detonator or detonator assembly counts down its stored number of oscillations before actuation, thereby to achieve its desired delay time.

DEFINITIONS

Figure 1:
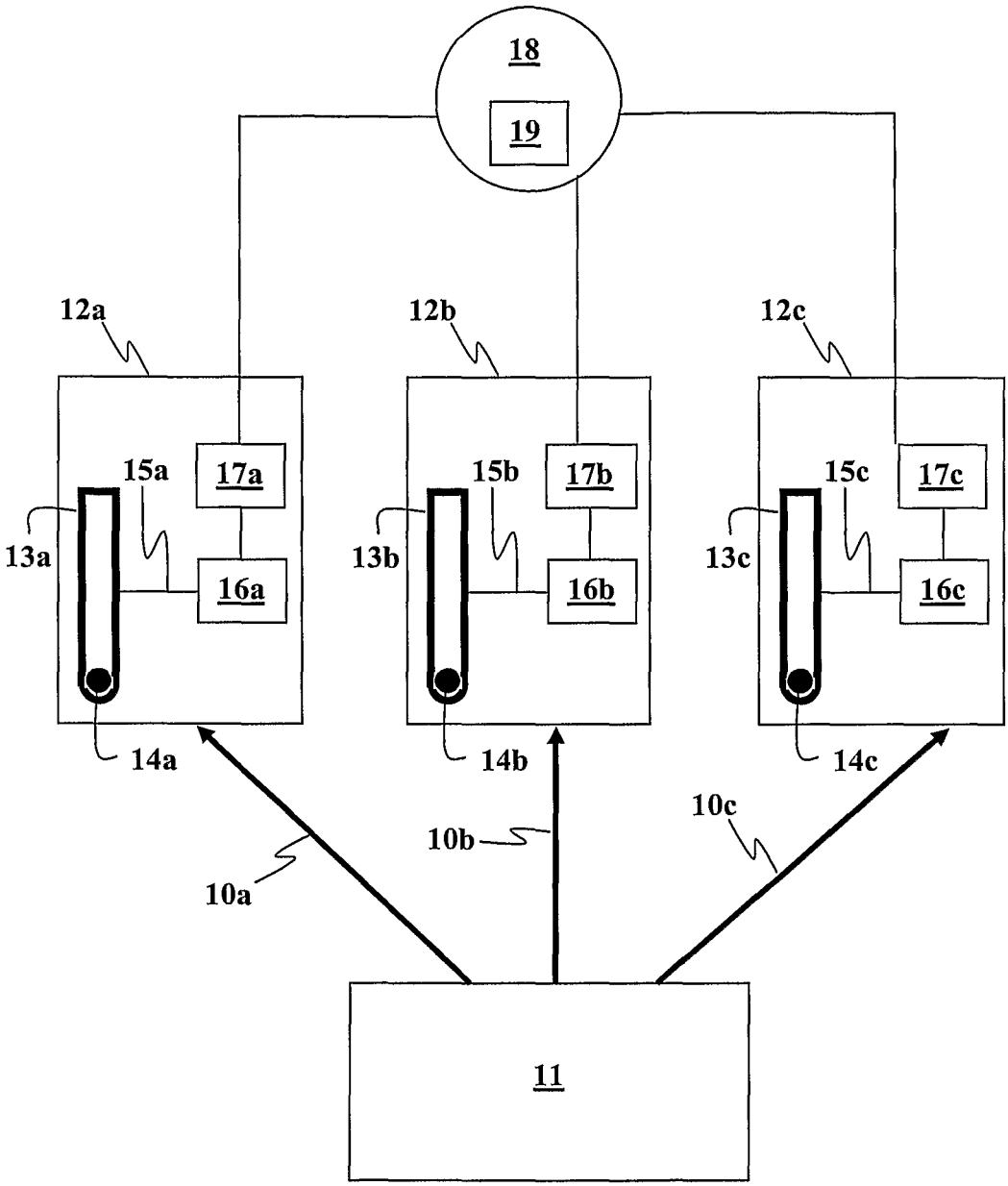
FIG. 1 provides a schematic view of en exemplary embodiment of a blasting apparatus.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within a main casing of a detonator, or alternatively may be located without any casing. The base charge may be used to deliver output power to an external explosives charge to initiate the external explosives charge.

Blast rehearsal: refers to one or more events that occur together or in sequence before a blasting event (involving detonator actuation) takes place, so as to 'practice' or 'rehearse' the blasting event. For example, in accordance with some aspects of the present invention, a blast rehearsal may involve various signals to allow a detonator or detonator assembly to determine a number of oscillation counts required for the detonator or detonator assembly to be programmed with or to execute a delay time.

Blast rehearsal start and stop signals: refer to signals transmitted by a high-accuracy clock or associated components to cause a countdown oscillator to count its oscillations between receipt of the blast rehearsal start and stop signals. Typically, the blast rehearsal start and stop signals may be temporally separated by a time interval corresponding to a desired delay time for the detonator assembly for a blasting event. In this way, the number of oscillations counted by the countdown oscillator will result in determination of a total oscillation count required by the countdown oscillator to achieve a delay time with a high level of accuracy relative to the desired delay time, and relative to other detonator assemblies forming part of the blasting apparatus set up for the blasting event.

Blasting machine: refers to any device that is capable of being in signal communication with electronic detonators, for transmitting signals to and/or from associated detonators or detonator assemblies, typically but not necessarily from a location remote from the detonators, via wired or wireless signal communication. For example, a blasting machine may transmit command signals to the detonators or detonator assemblies such as ARM, DISARM, and FIRE signals. A blasting machine may transmit data to program detonators or detonator assemblies with information relevant to a blast, such as for example delay times, detonator ID information etc. A blasting machine may also be capable of receiving information from associated detonators or detonator assemblies such as detonator status information, positional information, detonator ID information, acknowledge signals, or delay times relating to or programmed into the detonators or detonator assemblies. Signals may be received by a blasting machine directly from associated detonators or detonator assemblies. Alternatively, this data received from the detonators or detonator assemblies may be received via a receiver associated with or integral with the blasting machine. Alternatively, data transfer between a blasting machine and its associated detonators may at least in part be achieved via a logger. The blasting machine may be the only piece of equipment at the blast site controlling a blast, or a blasting machine may work in concert with other blasting machines or with other blasting equipment during the preparation for and/or during the execution of a blast such as a central command station.

Central command station: refers to any device that transmits signals via radio-transmission or by direct connection, to one or more blasting machines. The transmitted signals may be encoded, or encrypted. Typically, the central command station permits radio communication with multiple blasting machines from a location remote from the blast site.

Charge/charging/powering-up: refers to the act of causing a wireless detonator assembly of the invention to receive energy from a remote source, and convert the energy into electrical energy that is ultimately for use in activating a firing circuit to cause actuation of an associated base charge upon receipt of appropriate command signals. Preferably the energy is received through wireless means. 'Charging' and 'powering-up' have substantially the same meaning in the context of the present invention.

Countdown oscillator: refers to any clock or oscillator that is commonly used in connection with detonators and detonator assemblies known in the art for counting down a delay time just prior to detonator initiation. Such a clock or oscillator may typically be exposed to explosive or other physical forces during use and thus is preferably robust enough to continue operating at least during setup of a blasting apparatus and preliminary execution of a blasting event. Typically, such a countdown oscillator consists of a low-grade clock or oscillator that is inexpensive and less accurate than a high-accuracy clock. However, the countdown oscillators used in accordance with the present invention may operate at any frequency, although a frequency of from 0.5 kHz to more than 100 kHz may be preferred in some circumstances. Typically, a countdown oscillator associated with a detonator may comprise a "ring oscillator" (or "RC oscillator"), for example built into a semiconductor integrated circuit. Such devices may vary in accuracy from device to device, and vary in rate with voltage and/or temperature or other factors. Therefore, such devices inherently exhibit lower degrees of accuracy relative to high-accuracy clocks disclosed herein. International Patent Publication WO2008/138070 published Nov. 20, 2008, which is incorporated herein by reference, provides further discussion of oscillators and clocks that, in selected embodiments, may be utilized in accordance with the teachings of the present invention. It should be noted that the blasting apparatuses and methods of the present invention may be used with any such oscillators and high-accuracy clocks to achieve improved calibration of detonators for timed actuation, even for those comprising very fast oscillators with oscillation rates of more than 100 kHz for sub-millisecond delay time accuracy.

High-accuracy clock: encompasses any clock suitable for use in connection with a detonator assembly, and having an accuracy at least suitable for internal calibration of a detonator assembly in accordance with teachings herein. For example, in preferred embodiments the high-accuracy clock may have a high degree of accuracy and virtually no drift compared to a true time (e.g. less than 1 ms of drift per hour). In particularly preferred embodiments, the expression "high-accuracy clock" relates to a crystal clock, for example comprising an oscillating quartz crystal of the type that is well known, for example in conventional quartz watches and timing devices. Crystal clocks may provide particularly accurate timing in accordance with preferred aspects of the invention, and their fragile nature may in part be overcome by the teachings of the present application, including incorporation of a crystal clock into a top-box. In accordance with the teachings of the blasting apparatuses and methods disclosed herein, the high-accuracy clock of a detonator assembly is not required nor active during a blasting event, since responsibility for execution of the delay time is transferred to a countdown oscillator component of a blasting apparatus. In other embodiments, the accuracy of the high-accuracy clock may be achieved instead by way of synchronization of the high-accuracy clock to a carrier signal transmitted either over the wired harness of a wired blasting apparatus, or using wireless carrier signals transmitted wirelessly to all wireless detonator assemblies of a wireless blasting apparatus.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Electronic delay detonator (EDD): refers to any form of detonator that is able to process signals, such as electronic signals, originating for example from a blasting machine. In preferred embodiments, an EDD may be programmable with delay times (for example with a degree of accuracy to the nearest ms or better) or with other information to control the operation of the EDD.

Energy source: encompasses any source of energy that is capable of wirelessly transmitting energy to a detonator for the purpose of 'powering-up' or 'charging' the detonator for firing. In preferred embodiments the energy source may comprise a source of electromagnetic energy such as a laser.

Firing power supply: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a firing power source is a power source that may be charged and discharged with ease according to received energy and other signals. Most preferably the firing power source is a capacitor.

Forms of energy/wireless signals: refers to any form of energy appropriate for wireless signals/wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy. In selected embodiments, where radio communications are utilized for through-rock communications, the radio signals have a frequency of 100-2000 Hz, more preferably 200-1200 Hz.

Logging device: includes any device suitable for recording information with regard to the position of a detonator. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines.

Operating power supply: refers to any power source that can provide a continuous or constant supply of electrical energy. This definition encompasses devices that direct current such as a battery or a device that provides a direct or alternating current. For example, an active power source can provide power to a wireless signal receiving and/or processing means in a wireless detonator assembly, to permit reliable reception and interpretation of command signals derived from a blasting machine.

Preferably: identifies preferred features of the invention. Unless otherwise specified, the term preferably refers to preferred features of the broadest embodiments of the invention, as defined for example by the independent claims, and other inventions disclosed herein.

Storage component: refers to any means (software or hardware) of a detonator assembly to store information relevant for calibration or execution of instructions to FIRE by the detonator assembly. For example, a storage component may store information such as, but not limited to, a programmed or otherwise desired delay time for the detonator assembly. Alternative, or in addition, the storage component may store a total oscillation count determined for the detonator assembly, wherein the total oscillation count is as herein described.

Top-box: refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near an opening of a borehole. In this way, a top-box is more suited to receive and optionally transmit wireless signals, and/or for relaying these signals to the detonator and associated components down the borehole. In preferred embodiments, each top-box comprises one or more selected components of the wireless detonator assembly of the present invention. For example, a top-box may comprise a receiver, a transmitter, or a transceiver, as well as a high-accuracy clock for calibration of the wireless detonator assembly in accordance with a desired delay time for a blast. Optionally, the top-box may further include other components such as but not limited to means for storing a delay time for the wireless detonator assembly, and means to transmit signals to an associated detonator and related components also forming part of the wireless detonator assembly.

Total oscillation count: refers to a number of counts of a low-grade clock or other oscillator associated with a detonator or detonator assembly that occur between receipt by a detonator assembly of a blast-rehearsal start signal and a blast-rehearsal stop signal each transmitted by a high-accuracy clock or associated components. For example, the time interval between the blast-rehearsal start and stop signals may, at least in preferred embodiments, correspond to a desired delay time for the detonator assembly when the blast takes place (i.e. when the detonator assembly receives a command signal to FIRE from an associated blasting machine). In this way, the total oscillation count for the low-grade clock or other oscillator will correspond to a number of counts that must be counted by the low-grade clock or oscillator to achieve the desired delay time upon receipt of a command signal to FIRE.

Wireless detonator assembly: refers in general to an assembly encompassing a detonator, most preferably an electronic detonator (typically comprising at least a detonator shell and a base charge) as well as wireless signal receiving and processing means to cause actuation of the base charge upon receipt by said wireless detonator assembly of a wireless signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to wirelessly transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to an electronic delay detonator or any other form of detonator. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator for actuation thereof, in effect forming wireless branch lines in the wireless network. A wireless detonator assembly may further include a top-box as defined herein, for retaining specific components of the assembly away from an underground portion of the assembly during operation, and for location in a position better suited for receipt of wireless signals derived for example from a blasting machine or relayed by another wireless detonator assembly.

Wireless: refers to there being no physical connections (such as electrical wires, shock tubes, LEDC, or optical cables) connecting the detonator of the invention or components thereof to an associated blasting machine or power source.

Wireless electronic delay detonator (WEDD): refers to any electronic delay detonator that is able to receive and/or transmit wireless signals to/from other components of a blasting apparatus. Typically, a WEDD takes the form of, or forms an integral part of, a wireless detonator assembly as described herein.

DETAILED DESCRIPTION OF THE INVENTION

Blasting of rock for the purposes of mining may involve non-electric, or electric delay detonators. Nowadays, electronic delay detonators (EDDs) are becoming preferred detonator devices for blasting due to their reliability and safety, as well as their programmability, for example with delay times sometimes having an accuracy of 1 ms or less. EDDs may typically comprise an internal, low-grade clock device (or other oscillator) that requires calibration prior to a blasting event, to ensure that the individual delay times of the EDDs are executed with accuracy relative to one another. Some clocks may operate faster or slower than others, and their calibration prior to blasting helps to avoid delay time inaccuracies resulting from internal variances in the low-grade internal clocks of the EDDs. This in turn ensures that the desired blasting pattern is effected, resulting for example in desired shockwave interference, efficient rock fragmentation, and movement of fragmented rock in accordance with the intentions of the blast operator(s). Moreover, calibration of EDDs just prior to a blasting event helps to minimize the effects of unwanted clock drift, since any temporal change in clock performance and accuracy would be expected to be negligible between EDD calibration and blasting.

Traditionally, EDDs are calibrated relative to a "master clock" that may be optionally located remote from the blasting area, for example near or forming part of an associated blasting machine or central command station. With wired or wireless blasting arrangements, a start signal and a stop signal defining a known intervening time period may be transmitted to EDDs from a master clock, with each EDD counting a number of counts or oscillations for its internal clock for a time period extending between the receipt of the start and stop signals. Each EDD is subsequently required to "report back" by sending out signals to a recordation device (e.g. forming part of an associated blasting machine, master clock, or other device) regarding its counts or oscillations recorded for the time period. This data is gathered by the recording device typically remote from the blast site so that the recordation device can compare the oscillation counts, and thus the relative speeds, of the low-grade clocks associated with the EDDs. Subsequently, the recordation device can individually instruct each EDD to adjust its programmed delay time to account for the relative speed and inaccuracies of its internal low-grade clock.

It will be appreciated that such methods are cumbersome in several respects. Firstly, it is necessary for each signal transmitted either to or from an EDD to specifically identify the EDD, thus increasing the complexity of the signals, and requiring each EDD and the recordation device to successfully interpret each signal (with regard to EDD it is intended for, or which EDD it has been transmitted from). Further, the calibration process requires a significant number of signals to be transmitted to and from the EDDs and the recording device. Whilst this may be conducted with comparative ease in wired blasting systems, in wireless blasting systems the calibration process presents a technical challenge to ensure that all of the numerous wireless signals are not "lost" in transit, or improperly acted upon by the incorrect device. Finally, such calibration methods may at times only be effective if the blasting machine or recordation device individually address each EDD in series, to ensure that signals transmitted to and from the EDDs are correctly processed without confusion or complications. Such serial communications are tedious, and may take an unacceptably long time to complete, especially when a larger number of EDDs are present for the blast. For example, International Patent Publication WO2008/098302 published Aug. 21, 2008, which is incorporated herein by reference, discusses issues relating to serial communications in blasting.

The exemplary apparatuses and methods disclosed herein can, at least in selected embodiments, streamline EDD calibration for wired and/or wireless blasting arrangements. These apparatuses and methods reduce the need for significant signal transmission to or from the EDDs at a blast site. Calibration can be carried out by components internal to, or closely associated with, each individual EDD. In addition they effect an improvement in system timing accuracy, especially for longer individual delays.

One exemplary embodiment of an apparatus for conducting a blasting event will now be described with reference to FIG. 1. The apparatus includes at least one blasting machine 11 (only one is shown for simplicity) for sending command signals 10*a*, 10*b*, 10*c* to a plurality of associated detonator assemblies. In accordance with any embodiment of the present invention, the command signals 10*a*, 10*b*, 10*c* may be transmitted either via wired or via wireless connections. The apparatus further comprises detonator assemblies 12*a*, 12*b*, 12*c* (only three are shown in communication with a single blasting machine for simplicity). Moreover, each detonator assembly comprises:

(i) a detonator 13*a*, 13*b*, 13*c*, including a base charge 14*a*, 14*b*, 14*c* connected to a firing circuitl5*a*, 15*b*, 15*c;*

(ii) a storage component 16*a*, 16*b*, 16*c* for storing a programmed delay time and/or a total oscillation count;

(iii) a countdown oscillator 17*a*, 17*b*, 17*c*.

The apparatus further comprises at least one high-accuracy clock 18 (only one is shown for simplicity) each either associated with, or forming an integral component of, at least one detonator assembly. In the embodiment illustrated in FIG. 1, only one high-accuracy clock is shown as a component separate but in communication with each detonator assembly 12*a*, 12*b*, 12*c*. The high-accuracy clock 18 comprises transmitter 19 for sending a blast-rehearsal start signal and a blast-rehearsal stop signal to each countdown oscillator of each associated detonator assembly. Importantly, the high-accuracy clock 18 or associated transmitter 19 sends a pair of blast-rehearsal signals that are specific for each detonator assembly, since each pair of signals are temporally separated by a time period corresponding to a desired delay time individually selected for each detonator assembly. Moreover, each oscillator counts a number of oscillations between the pair of signals to determine a total oscillation count for each oscillator, corresponding to the desired delay time specific for each detonator assembly. For example, if detonator assembly 12*a* is required to have a delay time of 20 ms and it includes a countdown oscillator 17*a* oscillating at 1,000 Hz, then a total of 20 oscillations of oscillator 17*a* would be counted between receipt of the blast-rehearsal start and blast-rehearsal stop signals specific for detonator assembly 12*a*. On the other hand, if detonator assembly 12*b* is required to have a delay time of 30 ms and it includes a countdown oscillator 17*b* oscillating at 1200 Hz, then a total of 36 oscillations of oscillator 17*b* would be counted between receipt of the blast-rehearsal start and blast-rehearsal stop signals specific for detonator assembly 12*b*. Finally, if detonator assembly 12*a* is required to have a delay time of 15 ms and it includes a countdown oscillator 17*a* oscillating at 800 Hz, then a total of 12 oscillations of oscillator 17*c* would be counted between receipt of the blast-rehearsal start and blast-rehearsal stop signals specific for detonator assembly 12*c*.

Therefore, a pair of blast-rehearsal signals is transmitted to each detonator assembly, with each pair being specific for a detonator assembly and being temporally spaced by a time period corresponding to the desired delay time for the detonator assembly when executing the blast. The apparatus of the present invention effectively permits a "rehearsal" of the blasting event by the detonator assemblies, so that each detonator assembly can itself determine a number of internal oscillator counts required to accomplish its desired delay time, via signals received from transmitter 19. Thus, by receiving a pair of blast-rehearsal signals from the high-accuracy clock or associated components, each detonator assembly may determine its corresponding total oscillation count (by the length of the time interval between the pair of signals), and further may be calibrated in a simple and efficient manner. Notably, this is achieved via one-way communication from clock 18 (with transmitter 19) to the detonator assemblies 12*a*, 12*b*, 12*c* without need for each detonator to "report back" to the clock 18, transmitter 19, or other components of the blasting apparatus. Thus, blast site communications (e.g. for programming of delay times and calibration of the detonator assemblies in situ at the blast site) is simplified significantly compared to previous methods, with reduced possibility of programming or calibration errors.

As discussed, each detonator assembly 12*a*, 12*b*, 12*c* comprises a storage component 16*a*, 16*b*, 16*c*. Each storage component may, if required, store a programmed delay time for its respective detonator assembly. The primary function of each storage component is to store, either temporarily or permanently, the total oscillation count for the detonator assembly determined as described above. The purpose of each storage component is thus to place each detonator assembly into a ready state for the blasting event. Once a total oscillation count has been determined and stored by a detonator assembly, receipt by the detonator assembly of a command signal to FIRE from a blasting machine initiates its countdown oscillator to countdown its total oscillation count, whereupon completion of this countdown results in detonator actuation. In this way, timed actuation of each detonator assembly in accordance with individual desired delay times is achieved.

The apparatus shown in FIG. 1 is suitable for use in connection with both wired and wireless blasting arrangements involving either wired or wireless connections between the detonator assemblies and the blasting machine(s). Each detonator assembly may comprise or be associated with its own high-accuracy clock, or one high-accuracy clock may be in communication with multiple detonator assemblies. Moreover, the communication links between each detonator assembly and its associated high-accuracy clock may involve wired or wireless communication.

Figure 2:
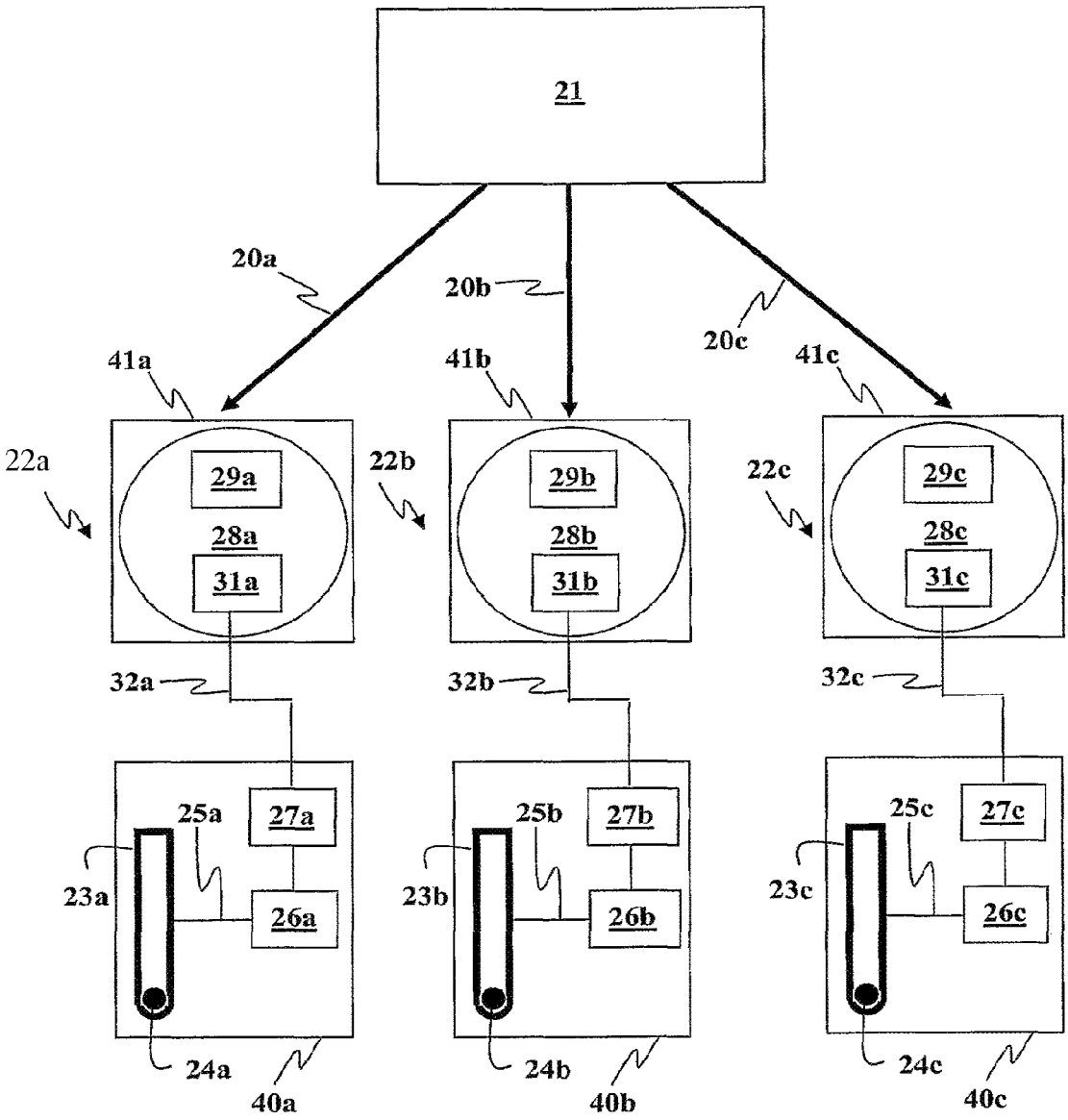
FIG. 2 provides a schematic view of en exemplary embodiment of a blasting apparatus involving wireless detonator assemblies.

Turning now to FIG. 2, there is shown a particularly preferred embodiment of an apparatus or the present invention, specifically adapted for wireless communication between each detonator assembly and each blasting machine. Again for ease of illustration, only a single blasting machine and three detonator assemblies are shown. Blasting machine 21 is in wireless command signal communication 20*a*, 20*b*, 20*c* with wireless detonator assemblies 22*a*, 22*b*, 22*c*. Each wireless detonator assembly 22*a*,22*b*, 22*c* includes a downhole portion 40*a*, 40*b*, 40*c* for placement below ground, for example associated with an explosive charge in a borehole in rock. Each wireless detonator assembly 22*a*, 22*b*, 22*c* further includes a top-box portion 41*a*, 41*b*, 41*c*, for location at the blast site at or near a surface of the ground, for reasons that will become apparent. Components that form part of downhole portion 40*a*, 40*b*, 40*c* and top-box portion 41*a*, 41*b*, 41*c* may be in wired or short-range wireless communication (e.g. radio communication) with one another. For the sake of illustration, FIG. 2 shows wired connections 32*a*, 32*b*, 32*c* between the downhole portion 40*a*, 40*b*, 40*c* and top-box 41*a*, 41*b*, 41*c*.

Downhole portion 40*a*, 40*b*, 40*c* includes detonator 23*a*, 23*b*, 23*c* including base charge 24*a*, 24*b*, 24*c* connected to firing circuit 25*a*, 25*b*, 25*c*. Also included in downhole portion 40*a*, 40*b*, 40*c* are storage component 26*a*, 26*b*, 26*c* and countdown oscillator 27*a*, 27*b*, 27*c*, which function in the same manner as components illustrated in FIG. 1.

However, in the apparatus illustrated in FIG. 2, each top-box 41*a*, 41*b*, 41*c* is shown to include an individual high-accuracy clock 28*a*, 28*b*, 28*c* for each detonator assembly. In this way, each high-accuracy clock 28*a*, 28*b*, 28*c* forms an integral part of each detonator assembly 22*a*, 22*b*, 22*c* and yet each high accuracy clock 28*a*, 28*b*, 28*c* is located at a distance from each corresponding detonator located beneath the ground, and the possibility of damage or impaired function of each high-accuracy clock during a blasting event (for example resulting from flying rock) is thus reduced. It follows that such high-accuracy clocks may involve crystal clocks, which although more fragile than other clock or oscillator types, offer superior levels of accuracy.

It should be noted that for ease of illustration in FIG. 2, one top-box is shown in connection with one detonator assembly. However, in other embodiments one top-box may be associated with two or more detonators via two or more downhole portions. Furthermore, other components illustrated in downhole portion 40*a*, 40*b*, 40*c* may be located in top-box 41*a*, 41*b*, 41*c* and vice versa. For example, storage component 26*a*, 26*b*, 26*c* and optionally countdown oscillator 27*a*, 27*b*, 27*c* may be located in top-box 41*a*, 41*b*, 41*c*.

Further illustrated in FIG. 2, and located in top-box 41*a*, 41*b*, 41*c*, are means 29*a*, 29*b*, 29*c* for sending a blast-rehearsal start signal and a blast-rehearsal stop signal to its associated countdown oscillator 26*a*, 26*b*, 26*c* of each associated detonator assembly. Each means 29*a*, 29*b*, 29*c* thus functions in a similar manner to means 19*a*, 19*b*, 19*c* of FIG. 1, except that only one pair of blast-rehearsal signals need necessarily be generated by each means, since they are directed only to a single countdown oscillator.

Also illustrated in FIG. 2, and located in top-box 41*a*, 41*b*, 41*c* are receiver 31*a*, 31*b*, 31*c* for receiving at least one wireless command signal from detonator 21. Such receiver may take any suitable form for receiving any type of wireless command signal, including but not limited to radio signals, other forms of electromagnetic radiation etc. Although not illustrated, each top-box may further include a transmitter for transmitting wireless signals to a blasting machine or other components of a blasting apparatus, for example to inform a blasting machine or other components of its status, delay time, or total oscillator count determined for the detonator assembly. Although not illustrated, any receiver and transmitter may be combined into a single transceiver unit.

Also not illustrated in FIG. 2 are power supplies in the wireless detonator assemblies. Such power supplies may take an active form such as a battery, or a passive form such as a capacitor, to power components of the assembly contained within the top-box and/or the downhole portion. For example, an operating power supply may be present to provide general power for functions of the wireless detonator assembly such as receiving wireless signals, and a firing power supply may be present for providing power to the firing circuit to initiate the detonator.

Thus, the embodiment illustrated in FIG. 2 encompasses one embodiment of the invention involving wireless communication between a blast machine and a plurality of wireless detonator assemblies. A skilled artisan will appreciate the manner in which the apparatus shown in FIG. 2 takes advantage of the presence of a top-box that is spatially separated from a detonator and associated components, each including a high-accuracy clock as an integral component of the top-box for calibration of a lower-grade clock or oscillator associated directly with the detonator down a borehole in rock. This configuration presents significant advantages. For example, once the detonator assembly has been programmed with its desired delay time, subsequent calibration and blasting steps require no further input from external sources (other than perhaps the need for receipt of a command signal to FIRE from a blasting machine). Rather, calibration of the wireless detonator assembly is conducted internally using components within the wireless detonator assembly. Hence, the need for cross-talk between a blasting machine, master clock, or other device to calibrate each wireless detonator assembly is significantly reduced or substantially eliminated. The top-box is "instructed" (e.g. via radio signal or other remote signaling means) to perform the calibration. Preferably, it may then provide power to its associated detonator(s) to charge a capacitor to a working voltage, and then withdraw further electrical supply, thereby emulating the behaviour of the wireless detonator assembly at blast time. Effectively, the use of the blast-rehearsal start and stop signals separated by a whole time period for the desired delay time, the detonator assembly "rehearses" the blasting event as a calibration step with all detonator-specific variables taken into account, where possible. The detonator is then able to use the "total oscillation count" for the rehearsed blast for the purpose of its actual delay time for the blasting event, which at least in preferred embodiments may occur just a few moments later. The methods and apparatuses of the invention therefore employ a "calibration whole delay", whereby each detonator assembly is calibrated based upon its whole delay time. In this way, the detonators may be calibrated in parallel with one another with relative ease.

With continued reference to FIG. 2, calibration may begin as soon as a detonator assembly has been programmed with a desired delay time for the blast. If all detonator assemblies have been programmed with their delay times, then calibration may commence at any time, with the blast operator safe in the knowledge that each calibration event is occurring as an internal event within each detonator assembly, without need for any or excessive "chatter" (e.g. wireless signals) between components of the blasting apparatus. Thus the apparatus uses time efficiently, since the blasting machine does not need to address each individual detonator assembly in turn. Rather, calibration of all detonator assemblies may occur simultaneously, if desired and appropriate. Alternatively, it may also be advantageous and time-efficient to calibrate those detonator assemblies with the longest delay times first, with calibration of other detonator assemblies commencing soon thereafter.

Typically, the accuracy of the high-accuracy clocks is accomplished by virtue of the internal characteristics of the high-accuracy clocks. For example, such high-accuracy clocks may be crystal clocks. In other embodiments, the accuracy of the high-accuracy clock may be achieved not by virtue of the internal characteristics and accuracy of the high-accuracy clock, but instead by way of synchronization of the high-accuracy clock to a carrier signal transmitted either over the wired harness of a wired blasting apparatus, or using wireless carrier signals transmitted wirelessly to all wireless detonator assemblies of a wireless blasting apparatus.

Thus, for greater certainty, selected exemplary embodiments provide an apparatus for conducting a blasting event, the apparatus comprising:

at least one blasting machine for sending command signals to a plurality of associated detonator assemblies;

a plurality of detonator assemblies in signal communication with said at least one blasting machine, each detonator assembly comprising:

(i) a detonator including a base charge connected to a firing circuit;

(ii) a storage component for storing a programmed delay time and/or a total oscillation count;

(iii) a countdown oscillator;

at least one high-accuracy clock each either in communication with, or forming an integral component of, at least one detonator assembly, and comprising means for sending a blast-rehearsal start signal and a blast-rehearsal stop signal to each countdown oscillator of each associated detonator assembly, said signals being temporally separated by a time period corresponding to a desired delay time individually selected for each detonator assembly, each oscillator counting a number of oscillations between said signals to determine a total oscillation count for each oscillator corresponding to said desired delay time specific for each detonator assembly;

whereupon receipt by said at least one detonator assembly of a command signal to FIRE from said at least one blasting machine, each countdown oscillator counting down its total oscillation count, thereby to achieve timed actuation of each detonator in accordance with its desired delay time.

In preferred embodiments, each detonator assembly is a wireless detonator assembly for wireless communication with the blasting machine, each further comprising: an operating power supply; a receiver for receiving at least one command signal from said at least one blasting machine; and optionally a transmitter for transmitting at least one wireless signal to said at least one blasting machine.

In accordance with any embodiments of the apparatuses disclosed herein, the at least one command signal is selected from a signal to ARM, DISARM, CALIBRATE, or FIRE, or a signal which confers to each wireless detonator assembly a desired delay time. Signals transmitted from each detonator assembly (if present) may include the total oscillator count for each detonator assembly for recordal by the at least one blasting machine.

Further, in accordance with the present invention, each wireless detonator assembly preferably includes a top-box adapted to be positioned near or above a surface of the ground when the wireless detonator assembly is at the blast site, each top box being in communication with said detonator positioned down a bore-hole below a surface of the ground, each top-box at least containing the high-accuracy clock. Further teachings with regard to the use of top-boxes in accordance with wireless detonator assemblies may be found, for example, in international patent publication WO2006/076777 published Jul. 27, 2006, which is incorporated herein by reference. Each top-box preferably comprises charging means and each detonator preferably further comprises a firing power supply associated with each firing circuit of each detonator, so that upon transmission of said blast-rehearsal start signal said charging means charges said firing power supply and then withdraws power to said detonator and associated components, thereby to mimic said blasting event at least during said time period between said blast-rehearsal start and stop signals.

In accordance with any embodiments of the apparatuses and methods of the present invention, any signals transmitted at the blast site via wireless means may optionally include some form of coding or identification to facilitate their receipt and processing by appropriate detonators or wireless detonator assemblies. For example, each blast rehearsal start and stop signal may, in selected embodiments, be directed only to one or a few detonator assemblies present at the blast site. Each detonator assembly may "check" the coding or identification of each received signal to confirm whether or not it is required to take action in response to each signal.

In other embodiments, additional coding or identification of each blast rehearsal start and stop signal may be unnecessary. For example, each wireless detonator assembly at a blast site may be pre-programmed with a specific delay time, and the blast rehearsal start and stop signals may define a series of time-periods virtually equivalent to the pre-programmed delay times, such that each wireless detonator assembly may calibrate its internal oscillator to the time-period that most closely matches its pre-programmed delay time. For example, if ten wireless detonator assemblies are present at the blast site, individually pre-programmed with delay times of 5 ms, 10 ms, 15 ms, 20 ms etc., then drift of the internal oscillators of up to 1 ms could be readily corrected by calibration to a series of blast rehearsal start and stop signals that accurately define a series of time-periods of 5 ms, 10 ms, 15 ms, 20 ms etc.

The apparatuses and methods of the present invention are suitable to calibrate the internal oscillators or detonators and detonator assemblies regardless of their rate of oscillation, and regardless or the degree of accuracy required for the delay times. In selected embodiments, the internal oscillators may oscillate at a rate of a few hundred or a few thousand Hz, thereby to achieve delay time accuracy to the nearest millisecond, or to the nearest ten or hundred milliseconds. In yet further embodiments, the accuracy of the delay times may be significantly increased by the use of much faster internal oscillators, including those that may exceed 100 kHz. In this way, it is possible to achieve and calibrate detonators for delay times having sub-millisecond accuracy, for example to the nearest tenth or hundredth of a millisecond. International Patent Publication WO2008/138070 published Nov. 20, 2008, which is incorporated herein by reference, provides further discussion of oscillators and clocks that, in selected embodiments, may be utilized in accordance with the teachings of the present invention. It should be noted that the blasting apparatuses and methods of the present invention may be used with any such oscillators and high-accuracy clocks to achieve improved calibration of detonators for timed actuation, even for those comprising very fast oscillators with oscillation rates of more than 100 kHz for sub-millisecond delay time accuracy.

Transmission of blast rehearsal start and stop signals to the detonators or detonator assemblies may be carried out in any manner in order to achieve the desired delay time. For example, each pair of signals may be transmitted separately and in series to each detonator or wireless detonator assembly. Alternatively, the signals may be transmitted in parallel providing they can be appropriately differentiated by each detonator or detonator assembly as discussed above. If the signals are transmitted in parallel, then it may be advantageous to transmit a single blast rehearsal start signal to all detonators or detonator assemblies (or transmit multiple blast rehearsal start signals simultaneously to all detonators or detonator assemblies) with temporal staggering of the blast rehearsal stop signals to achieve programming and calibration for different delay times. Alternatively, it may be preferred to stagger the transmission of the blast rehearsal start signals so that a single blast rehearsal stop signal may be transmitted to all detonators or detonator assemblies (or multiple blast rehearsal stop signals may be transmitted at the same time to all detonators or detonator assemblies) to stop the programming/calibration process.

Other exemplary embodiments include methods including steps that correspond to the use of the apparatuses disclosed herein. For example, one such method is described with reference to FIG. 3. This method is for calibrating a detonator assembly for a blasting event, said detonator assembly comprising:

(i) a detonator including a base charge connected to a firing circuit;

(ii) a storage component for storing a programmed delay time and/or a total oscillation count;

(iii) a countdown oscillator.

Figure 3:
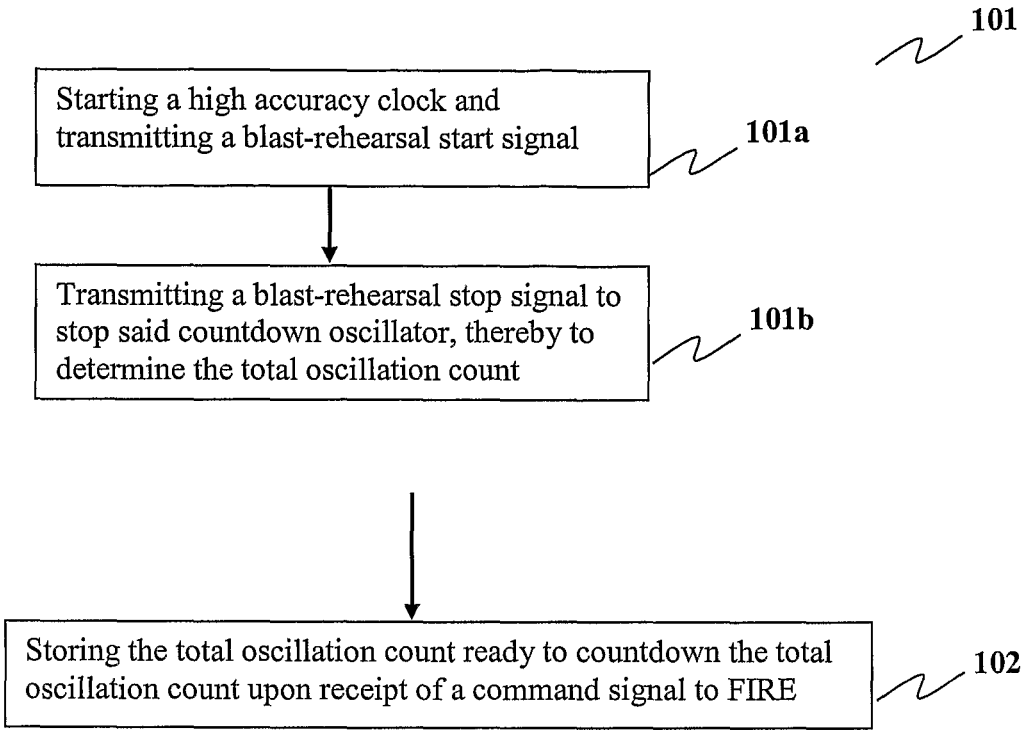
FIG. 3 provides an exemplary embodiment of a method of blasting.

Specifically, the method comprises:

in step 101 of FIG. 3, determining a total oscillation count for said countdown oscillator corresponding to a desired delay time specific for said detonator assembly, said step of determining comprising:

in step 101*a* starting a high-accuracy clock either in communication with or forming an integral component of the detonator assembly, and simultaneously transmitting a blast-rehearsal start signal to said countdown oscillator to cause said oscillator to start counting its oscillations;

in step 101*b* after a time-period has elapsed corresponding to said desired delay time said high-accuracy clock transmitting a blast-rehearsal stop signal to cause said oscillator to stop counting its oscillations, thus to provide said total oscillation count; and in step 102 storing said total oscillation count ready for said oscillator to count down said total oscillation count upon receipt by the detonator assembly of a signal to FIRE, whereupon completion of countdown of said total oscillation count, said base charge is actuated via said firing circuit.

In preferred embodiments of the method, the detonator assembly is a wireless detonator assembly for wireless communication with the blasting machine, further comprising:

an operating power supply;

a receiver for receiving at least one command signal from said at least one blasting machine; and optionally a transmitter for optionally transmitting at least one wireless signal to said at least one blasting machine for recordal thereby.

In further preferred embodiments, the wireless detonator assembly includes a top-box adapted to be positioned near or above a surface of the ground when the wireless detonator assembly is at the blast site, the top box being in communication with said detonator positioned down a bore-hole below a surface of the ground, the top-box at least containing the high-accuracy clock, wherein steps (1a) and (1b) of the method comprises transmission of said blast-rehearsal start and stop signals from said top-box via wired or wireless connection with said associated detonator located down said borehole. In selected embodiments, each top-box may further comprise charging means and each detonator may further comprises a firing power supply associated with each firing circuit of each detonator, so that in step (1a) of the method, upon transmission of said blast-rehearsal start signal said charging means charges said firing power supply and then withdraws power to said detonator and associated components, thereby mimicking said blasting event at least during said time period between said blast-rehearsal start and stop signals. In this way, the function and status of the detonator assembly closely resembles the behaviour of the detonator assembly at blast time (i.e. upon receipt of a command signal to FIRE).

During blasting, wired communication links or in the case of wireless blasting, apparatuses communication links with surface components such as top-boxes, may well be disrupted due to the force of the blast, movement of rock etc. As such, power supply provided over the wired harness or from a top-box to a detonator cannot be reliably maintained once the countdown to firing (e.g. countdown of delay times) has started. By charging the detonator firing circuit and then withdrawing power during the calibration step, the aim is to closely mimic the status and power transfer between detonator assembly components during blasting, so that the determination of the total oscillator count for a desired delay time is as accurate and as appropriate as possible for the actual blasting event.

Figure 4:
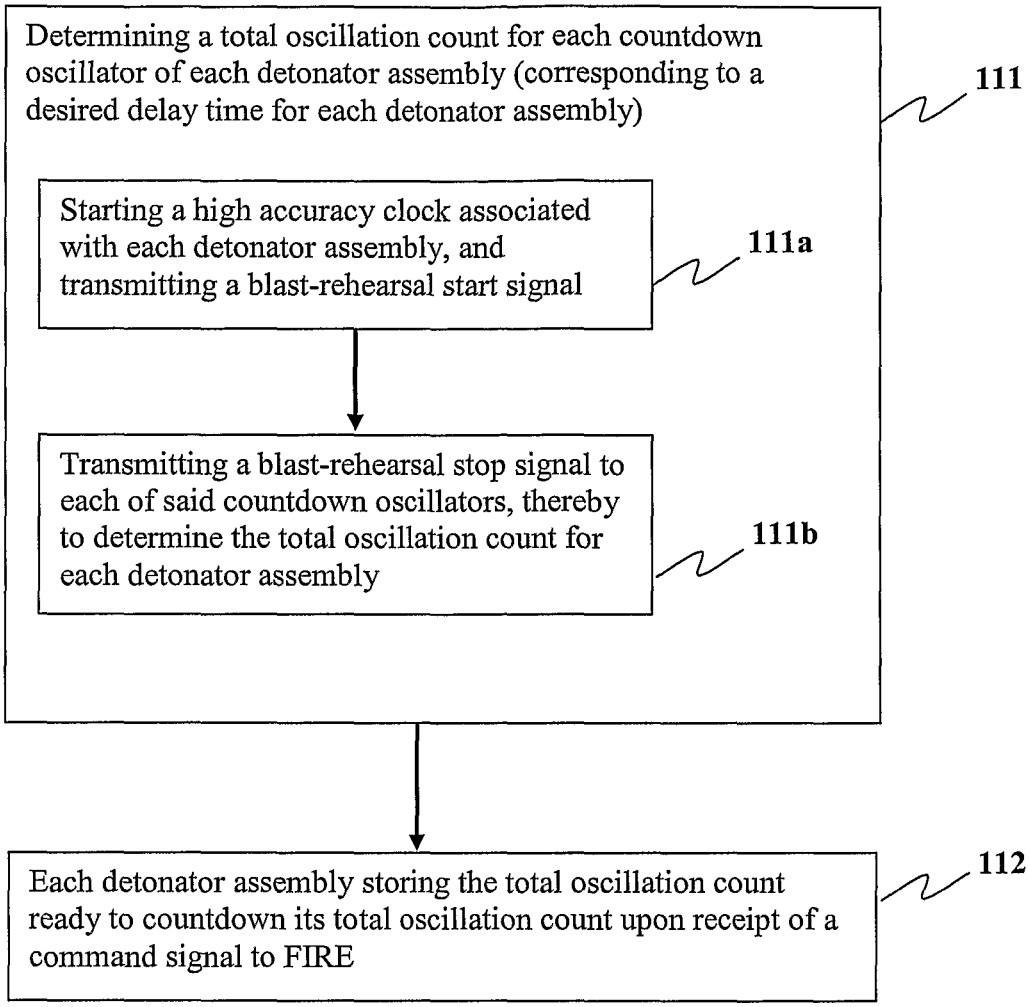
FIG. 4 provides an exemplary embodiment of a method of blasting.

Another exemplary embodiment of a method is illustrated with reference to FIG. 4. This method is for calibrating a plurality of detonator assemblies for a blasting event, each detonator assembly comprising:

(i) a detonator including a base charge connected to a firing circuit;

(ii) a storage component for storing a programmed delay time and/or a total oscillation count;

(iii) a countdown oscillator.

The method comprises the steps of:

in step 111 determining a total oscillation count for each countdown oscillator corresponding to a desired delay time specific for each detonator assembly, said step of determining comprising:

in step 111*a* starting a high-accuracy clock either in communication with or forming an integral component of each detonator assembly, and simultaneously transmitting a blast-rehearsal start signal to each countdown oscillator to cause each oscillator to start counting its oscillations;

in step 111*b* after a time-period has elapsed corresponding to each desired delay time each high-accuracy clock transmitting a blast-rehearsal stop signal to cause each oscillator to stop counting its oscillations, thus to provide said total oscillation count corresponding to each desired delay time for each detonator assembly; and in step 112 storing said total oscillation counts ready for said oscillators to count down said total oscillation counts upon receipt by the detonator assemblies of a signal to FIRE, whereupon completion of countdown of each total oscillation count, each base charge is actuated via said firing circuit, thereby to achieve timed actuation of the detonators in accordance with their desired delay times.

In a further exemplary embodiment there is provided a method for programming a plurality of detonators or detonator assemblies with delay times, and calibrating the internal oscillators of the detonators or detonator assemblies, the method comprising the step of:

transmitting to each detonator or detonator assembly a pair of signals comprising a blast rehearsal start signal and a blast rehearsal stop signal, said pair of signals being temporally spaced by a time-period equivalent to a desired delay time for each detonator or detonator assembly, wherein each detonator or detonator assembly counts and stores a number of oscillations for its internal oscillator for said time-period;

whereupon receipt of a command signal to FIRE, each detonator or detonator assembly counts down its stored number of oscillations before actuation, thereby to achieve its desired delay time.

Preferably, the blast rehearsal start and stop signals are transmitted by a transmitter associated with a high-accuracy clock, and in selected embodiments the internal oscillators of the detonators may oscillate with a frequency of 0.5 kHz to more than 100 kHz. In further selected embodiments at least one blast rehearsal start signal or at least one blast rehearsal stop signal is/are coded for receipt and/or processing by one or more selected detonators or detonator assemblies, for individual programming of detonators with delay times.

Whilst the invention has been described with reference to specific embodiments of the blasting apparatuses, and methods of blasting or calibration of the present invention, a person of skill in the art would recognize that other blasting apparatuses, and methods that have not been specifically described would nonetheless lie within the spirit of the invention. It is intended to encompass all such embodiments within the scope of the appended claims.

The invention claimed is:

1. An apparatus for conducting a blasting event, the apparatus comprising:

at least one blasting machine for sending command signals to a plurality of associated detonator assemblies;

a plurality of detonator assemblies in signal communication with said at least one blasting machine, each detonator assembly comprising:

(i) a detonator including a base charge connected to a firing circuit;

(ii) a storage component for storing a total oscillation count;

(iii) a countdown oscillator;

at least one high-accuracy clock each either in communication with, or forming an integral component of, at least one detonator assembly, and an associated transmitter for transmitting a blast-rehearsal start signal and a blast-rehearsal stop signal to each countdown oscillator of each associated detonator assembly, said signals being temporally separated by a time period corresponding to a desired delay time individually selected for each detonator assembly, thereby to mimic during said time period between said blast-rehearsal start signal and said blast-rehearsal stop signal, the desired delay time individually selected for each detonator assembly each oscillator counting a number of oscillations between said signals to determine a total oscillation count for each oscillator corresponding to said desired delay time specific for each detonator assembly;

whereupon receipt by said at least one detonator assembly of a command signal to FIRE from said at least one blasting machine, each countdown oscillator counting down its total oscillation count, thereby to achieve timed actuation of each detonator in accordance with its desired delay time.

2. The apparatus of claim 1, wherein each detonator assembly is a wireless detonator assembly for wireless communication with the blasting machine, each further comprising:

an operating power supply;

a receiver for receiving said blast-rehearsal start and stop signals; and optionally a transmitter for transmitting at least one wireless signal to said at least one blasting machine.

3. The apparatus of claim 1 or claim 2, wherein the at least one command signal is selected from a signal to ARM, DISARM, CALIBRATE, or FIRE, or a signal which confers to each wireless detonator assembly a desired delay time.

4. The apparatus of claim 2, wherein the at least one wireless signal transmitted from each detonator assembly includes the total oscillator count for each detonator assembly for recordal by the at least one blasting machine.

5. The apparatus of claim 2, wherein each wireless detonator assembly includes a top-box adapted to be positioned near or above a surface of the ground when the wireless detonator assembly is at the blast site, each top box being in communication with a detonator positioned down a bore-hole below a surface of the ground, each top-box at least containing one of said at least one high-accuracy clock.

6. The apparatus of claim 5, wherein each top-box further comprises charging means and each detonator further comprises a firing power supply associated with each firing circuit of each detonator, so that upon transmission of said blast-rehearsal start signal said charging means, charges said firing power supply and then withdraws power to said detonator and associated components, thereby to mimic said blasting event at least during said time period between said blast-rehearsal start and stop signals.

7. The apparatus of claim 1, wherein each countdown oscillator has a frequency of from 0.5 kHz to more than 100 kHz.

8. A method for calibrating a detonator assembly for a blasting event, said detonator assembly comprising:

(i) a detonator including a base charge connected to a firing circuit;

(ii) a storage component for storing a total oscillation count;

(iii) a countdown oscillator;

wherein the method comprises the steps of:

(1) determining a total oscillation count for said countdown oscillator corresponding to a desired delay time specific for said detonator assembly, said step of determining comprising:

(1 a) starting a high-accuracy clock either in communication with or forming an integral component of the detonator assembly, and simultaneously transmitting a blast-rehearsal start signal to said countdown oscillator to cause said oscillator to start counting its oscillations;

(1b) after a time-period has elapsed corresponding to said desired delay time said high-accuracy clock transmitting a blast-rehearsal stop signal to cause said oscillator to stop counting its oscillations, thereby to mimic during said corresponding time period between said blast-rehearsal start signal and said blast-rehearsal stop signal, the desired delay time specific for said detonator assembly and thus to provide said total oscillation count; and (2) storing said total oscillation count ready for said oscillator to count down said total oscillation count upon receipt by the detonator assembly of a signal to FIRE, whereupon completion of countdown of said total oscillation count, said base charge is actuated via said firing circuit.

9. The method of claim 8, wherein said detonator assembly is a wireless detonator assembly for wireless communication with the blasting machine, further comprising:

an operating power supply;

a receiver for receiving said blast-rehearsal start and stop signals; and optionally a transmitter for optionally transmitting at least one wireless signal to said at least one blasting machine for recordal thereby.

10. The method of claim 9, wherein said wireless detonator assembly includes a top-box adapted to be positioned near or above a surface of the ground when the wireless detonator assembly is at the blast site, the top box being in communication with said detonator positioned down a bore-hole below a surface of the ground, the top-box at least containing a high-accuracy clock, wherein steps (1a) and (1b) of the method comprise transmission of said blast-rehearsal start and stop signals from said top-box via wired or wireless connection with said associated detonator located down said borehole.

11. The method of claim 10, wherein each top-box further comprises charging means and each detonator further comprises a firing power supply associated with each firing circuit of each detonator, so that in step (1a) of the method, upon transmission of said blast-rehearsal start signal said charging means charges said firing power supply and then withdraws power to said detonator and associated components, thereby mimicking said blasting event at least during said time period between said blast-rehearsal start and stop signals.

12. A method for programming a plurality of detonators or detonator assemblies with delay times, and calibrating the internal oscillators of the detonators or detonator assemblies, the method comprising the step of:

transmitting to each detonator or detonator assembly a pair of signals comprising a blast-rehearsal start signal and a blast-rehearsal stop signal, said pair of signals being temporally spaced by a time-period equivalent to a desired delay time for each detonator or detonator assembly, thereby to mimic during the time period between the blast-rehearsal start signal and the blast-rehearsal stop signal, the desired delay time for each detonator or detonator assembly wherein each detonator or detonator assembly counts and stores a number of oscillations for its internal oscillator for said time-period;

whereupon receipt of a command signal to FIRE, each detonator or detonator assembly counts down its stored number of oscillations before actuation, thereby to achieve its desired delay time.

13. The method of claim 12, wherein the blast-rehearsal start and stop signals are transmitted by a transmitter associated with a high-accuracy clock.

14. The method of claim 13, wherein the internal oscillators of the detonators oscillate with a frequency of 0.5 kHz to more than 100 kHz.

15. The method of claim 14, wherein at least one blast-rehearsal start signal or at least one blast-rehearsal stop signal is / are coded for receipt and / or processing by one or more selected detonators or detonator assemblies, for individual programming of detonators or detonator assemblies with delay times.

16. The method of claim 12, wherein each detonator assembly is a wireless detonator assembly for wireless communication with the blasting machine, each further comprising:

an operating power supply;

a receiver for receiving at least one command signal from an associated blasting machine and/or said blast-rehearsal start and stop signals; and optionally a transmitter for optionally transmitting at least one wireless signal to said at least one blasting machine for recordal thereby.

17. The method of claim 16, wherein each wireless detonator assembly includes a top-box adapted to be positioned near or above a surface of the ground when the wireless detonator assembly is at the blast site, the top box being in communication with said detonator positioned down a borehole below a surface of the ground, the top-box at least containing a high-accuracy clock, wherein the step of transmitting comprises transmission of said blast-rehearsal start and stop signals from said top-box via wired or wireless connection with said associated detonator located down said borehole.

18. The method of claim 17, wherein each top-box further comprises charging means and each detonator further comprises a firing power supply associated with each firing circuit of each detonator, so that upon transmission of said blast-rehearsal start signal said charging means charges said firing power supply and then withdraws power to said detonator and associated components, thereby mimicking said blasting event at least during said time period between said blast-rehearsal start and stop signals.

* * * * *